US011110942B2

(12) United States Patent
Hatano et al.

(10) Patent No.: US 11,110,942 B2
(45) Date of Patent: Sep. 7, 2021

(54) RAILWAY VEHICLE STOPPER

(71) Applicants: Sumitomo Riko Company Limited, Aichi (JP); KAWASAKI JUKOGYO KABUSHIKI KAISHA, Hyogo (JP)

(72) Inventors: Motohiro Hatano, Aichi (JP); Kento Tamaki, Aichi (JP); Satoshi Ikeda, Hyogo (JP); Kazuo Isomura, Hyogo (JP); Takanori Tojo, Hyogo (JP)

(73) Assignees: SUMITOMO RIKO COMPANY LIMITED, Aichi (JP); KAWASAKI JUKOGYO KABUSHIKI KAISHA, Hyogo (JP)

( * ) Notice: Subject to any disclaimer, the term of this patent is extended or adjusted under 35 U.S.C. 154(b) by 355 days.

(21) Appl. No.: 16/277,204

(22) Filed: Feb. 15, 2019

(65) Prior Publication Data

US 2019/0300026 A1 Oct. 3, 2019

(30) Foreign Application Priority Data

Mar. 28, 2018 (JP) ..... JP2018-062628

(51) Int. Cl.
*B61F 5/52* (2006.01)

(52) U.S. Cl.
CPC ..... *B61F 5/52* (2013.01)

(58) Field of Classification Search
CPC ..... B61F 5/00; B61F 5/32; B61F 5/50; B61F 5/52
See application file for complete search history.

(56) References Cited

U.S. PATENT DOCUMENTS 9,061,689 B2 * 6/2015 Fujimoto ..... F16F 9/052
2013/0313764 A1 * 11/2013 Fujimoto ..... B61F 5/10 267/64.27
2017/0355387 A1 * 12/2017 Otsubo ..... F16F 1/3828
2019/0300026 A1 * 10/2019 Hatano ..... B61F 5/16

FOREIGN PATENT DOCUMENTS

JP 2009-51420 A 3/2009
JP 2014-4983 A 1/2014

* cited by examiner

*Primary Examiner* — Jason C Smith
(74) *Attorney, Agent, or Firm* — Greenblum & Bernstein, P.L.C.

(57) ABSTRACT

A railway vehicle stopper includes a first rigid member, a second rigid member, a rubber elastic body, a third rigid member, an abutting member, and a communication passage. The second rigid member is arranged opposed to the truck frame or the vehicle body with an interval. The rubber elastic body elastically couples the supporting portion of the first rigid member to the second rigid member. The third rigid member is mounted inside the supporting portion of the first rigid member to form an air chamber with the second rigid member. The abutting member is coupled to at least one of mutually opposed surfaces of the second rigid member and the third rigid member. The communication passage is provided on one or both of the first rigid member and the third rigid member to communicate the air chamber with an outside.

8 Claims, 8 Drawing Sheets

B
B
2
6
7
8
9
10
11
12
13
14
15

RAILWAY VEHICLE STOPPER

BACKGROUND

This application claims the benefit of Japanese Patent Application Number 2018-062628 filed on Mar. 28, 2018, the entirety of which is incorporated by reference.

TECHNICAL FIELD

The disclosure relates to a railway vehicle stopper arranged between a vehicle body and a truck of a railway vehicle to reduce shaking of the vehicle body with respect to the truck.

RELATED ART

A vehicle body and a truck of a railway vehicle are coupled by a traction apparatus on a side of the vehicle body. A railway vehicle stopper for preventing excessive rolling of the vehicle body with respect to the truck is secured to between the traction apparatus and the truck. As such a railway vehicle stopper, for example. Japanese Unexamined Patent Application Publication 2009-51420 discloses a rolling regulating tool that has a base plate, and a stopper rubber. The base plate is formed of a metal plate and secured to any one side of a truck frame and a traction frame. The stopper rubber is configured from, for example, a rubber portion and a metal fitting and disposed on a surface of the base plate such that a spring constant in a case of a compression with a predetermined amount or more is higher than a spring constant in a case of a compression with less than the predetermined amount. Japanese Unexamined Patent Application Publication 2014-4983 discloses a stopper member including a bracket secured to a traction apparatus, and a stopper main body secured to the bracket and formed of a base portion made of a non-self-lubrication rubber elastic body and a sliding portion made of a self-lubrication rubber elastic body.

In the above-described conventional railway vehicle stopper, a two-stage spring characteristic is obtained by adjustment of the respective spring constants between the rubber portion and the metal fitting and the respective spring constants between the base portion and the sliding portion.

However, change of the two-stage spring characteristic requires change of shapes of the respective components, which further requires remodeling of a mold. The remodeling of the mold leads an increase in cost. Further, when the mold is remodeled, it is impossible to create the product before the remodeling, which leads restriction to freedom of design.

Therefore, it is an object of the disclosure to provide a railway vehicle stopper that can adjust a two-stage spring characteristic at low cost and can improve freedom of design as well.

SUMMARY

In order to achieve the above-described object, there is provided a railway vehicle stopper interposed between a vehicle body and a truck frame of a railway vehicle according to a first aspect of the disclosure. The railway vehicle stopper includes a first rigid member, a second rigid member, a rubber elastic body, a third rigid member, an abutting member, and a communication passage. The first rigid member has an annular supporting portion, and a securing portion positioned at an outer peripheral side of the supporting portion. The securing portion is secured to the vehicle body or the truck frame. The second rigid member is arranged opposed to the truck frame or the vehicle body with an interval. The rubber elastic body elastically couples the supporting portion of the first rigid member to the second rigid member. The third rigid member is mounted inside the supporting portion of the first rigid member, and an air chamber is formed between the second rigid member and the third rigid member. The abutting member is coupled to at least one of mutually opposed surfaces of the second rigid member and the third rigid member. The communication passage is provided on one or both of the first rigid member and the third rigid member to communicate the air chamber with an outside.

According to a second aspect of the disclosure, which is in the first aspect of the disclosure, the communication passage may have a through-hole and a communication groove. The through-hole is formed on the third rigid member through the third rigid member in a thickness direction. The communication groove is formed on a surface abutting on the vehicle body or the truck frame in the third rigid member to be continuous with the through-hole.

According to a third aspect of the disclosure, which is in the second aspect of the disclosure, the communication groove may be formed on an outer peripheral edge of the abutting surface.

According to a fourth aspect of the disclosure, which is in the second aspect of the disclosure, the communication groove may be formed on an entire outer peripheral edge of the abutting surface.

According to a fifth aspect of the disclosure, which is in any one of the first to fourth aspects of the disclosure, a fourth rigid member having a surface opposed to the second rigid member may be mounted on the third rigid member.

According to a sixth aspect of the disclosure, which is in any one of the first to fifth aspects of the disclosure, the abutting member may be disposed on the second rigid member, and at least a pair of stoppers may be arranged on the third rigid member having a predetermined interval with a side surface of the abutting member.

According to a seventh aspect of the disclosure, which is in any one of the first to sixth aspects of the disclosure, a sliding member may be disposed on a side of the truck frame or the vehicle body in the second rigid member.

According to an eighth aspect of the disclosure, which is in any one of the first to seventh aspects of the disclosure, the third rigid member may be press-fitted inside the supporting portion.

The first aspect of the disclosure eliminates the need for remodeling the mold, thus ensuring the adjustment of the two-stage spring characteristic with the replacement or the remodeling of only the third rigid member. Accordingly, the adjustment of the two-stage spring characteristic can be performed at low cost. It is also possible to easily return to the two-stage spring characteristic before the adjustment with the replacement of the third rigid member, thus improving the freedom of design.

The second aspect of the disclosure can easily form the communication passage using the third rigid member, in addition to the effect of the first aspect.

The third aspect of the disclosure can easily form the communication groove using the outer peripheral edge of the third rigid member, in addition to the effect of the second aspect.

The fourth aspect of the disclosure can easily form the communication groove using the outer peripheral edge of the third rigid member and can easily make the communication groove be continuous with the through-hole since the communication groove is provided on the entire outer peripheral edge, in addition to the effect of the second aspect.

The fifth aspect of the disclosure can more finely adjust the spring characteristic with the third rigid member by employing the fourth rigid member, in addition to the effect of any of the first to fourth aspects.

The sixth aspect of the disclosure can adjust the spring characteristic in the sliding direction as well by employing the stopper, in addition to the effect of any of the first to fifth aspects.

The seventh aspect of the disclosure can smoothly abut on the vehicle body or the truck frame by employing the sliding member, in addition to the effect of any of the first to sixth aspects.

The eighth aspect of the disclosure can easily mount the third rigid member by press-fitting, in addition to the effect of any of the first to seventh aspects.

BRIEF DESCRIPTION OF THE DRAWINGS

FIG. 1A illustrates a plan view, and FIG. 1B illustrates a cross-sectional surface taken along a line A-A.

FIG. 2A illustrates a plan view, FIG. 2B illustrates a front view, and FIG. 2C illustrates a cross-sectional surface taken along a line B-B.

FIG. 3A illustrates a plan view, FIG. 3B illustrates a front view, and FIG. 3C illustrates a cross-sectional surface taken along a line C-C.

FIG. 5A illustrates a plan view, FIG. 5B illustrates a front view, and FIG. 5C illustrates a cross-sectional surface taken along a line D-D.

FIG. 6A illustrates a plan view, FIG. 6B illustrates a front view, and FIG. 6C illustrates a cross-sectional surface taken along a line E-E.

FIG. 7A illustrates a plan view. FIG. 7B illustrates a front view, and FIG. 7C illustrates a cross-sectional surface taken along a line F-F.

DETAILED DESCRIPTION

The following describes embodiments of the disclosure based on the drawings.

Figure 1B:
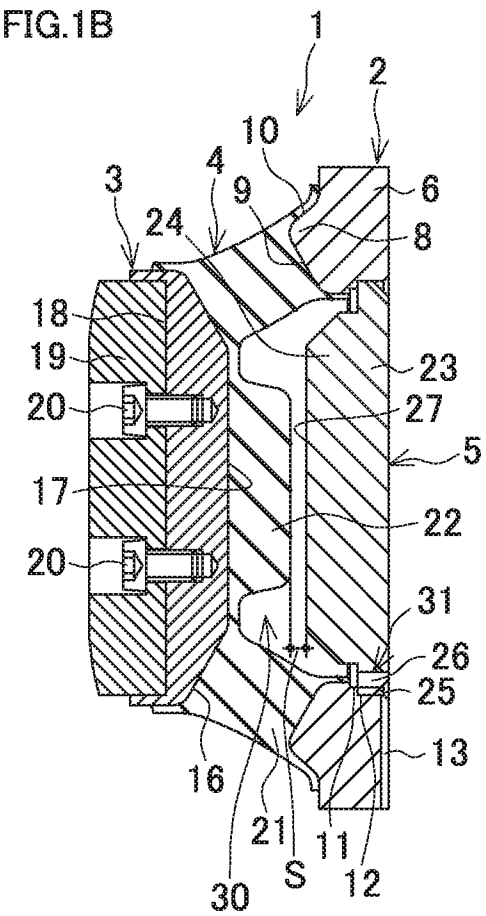
FIGS. 1A and 1B are explanatory diagrams of a railway vehicle stopper.
Figure 1A:
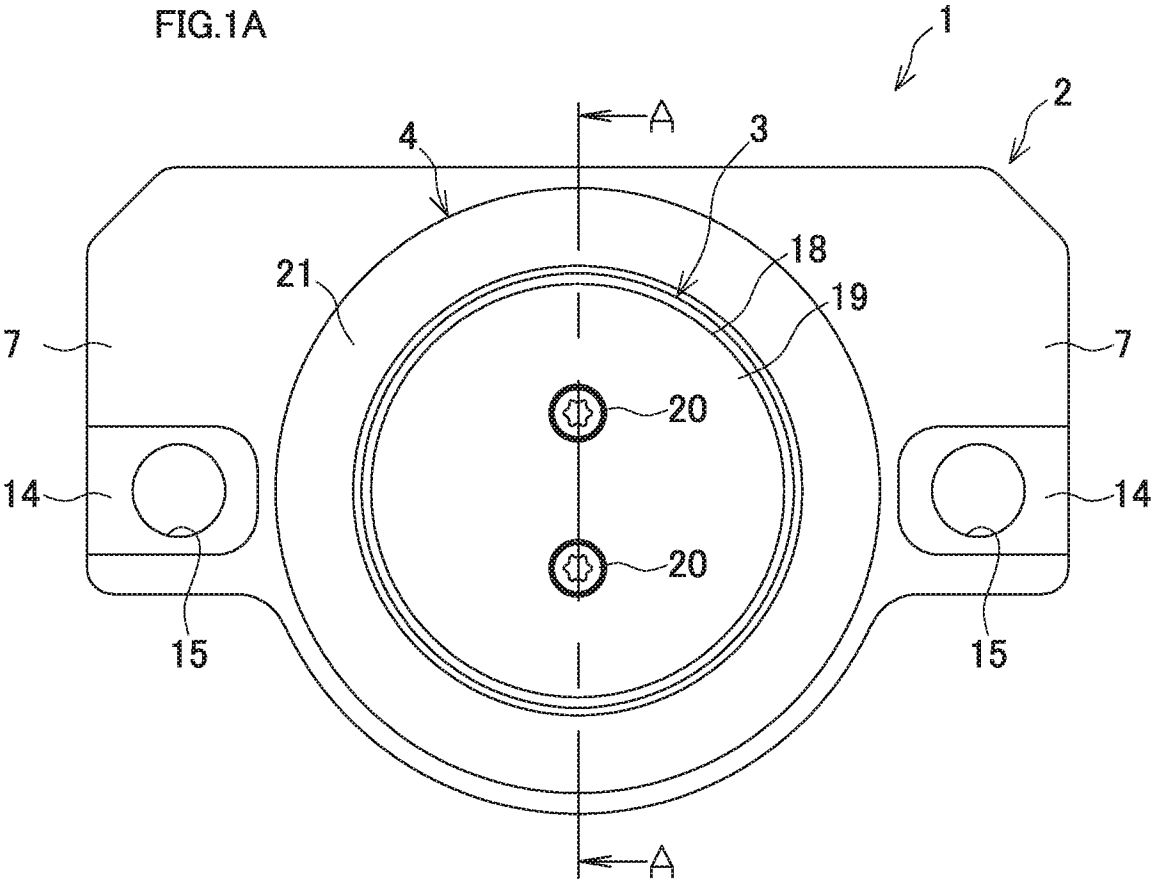

FIGS. 1A and 1B are explanatory diagrams illustrating an exemplary railway vehicle stopper, FIG. 1A is a plan view, and FIG. 1B is a cross-sectional surface taken along a line A-A. Such a railway vehicle stopper 1 includes a lower fitting 2 as a first rigid member, an upper fitting 3 as a second rigid member arranged at a position upward apart from the lower fitting 2, a rubber elastic body 4 that elastically couples the lower fitting 2 to the upper fitting 3 between them, and a press-fit fitting 5 as a third rigid member mounted on the lower fitting 2 by press-fitting.

Figures 2A, 2B, 2C:
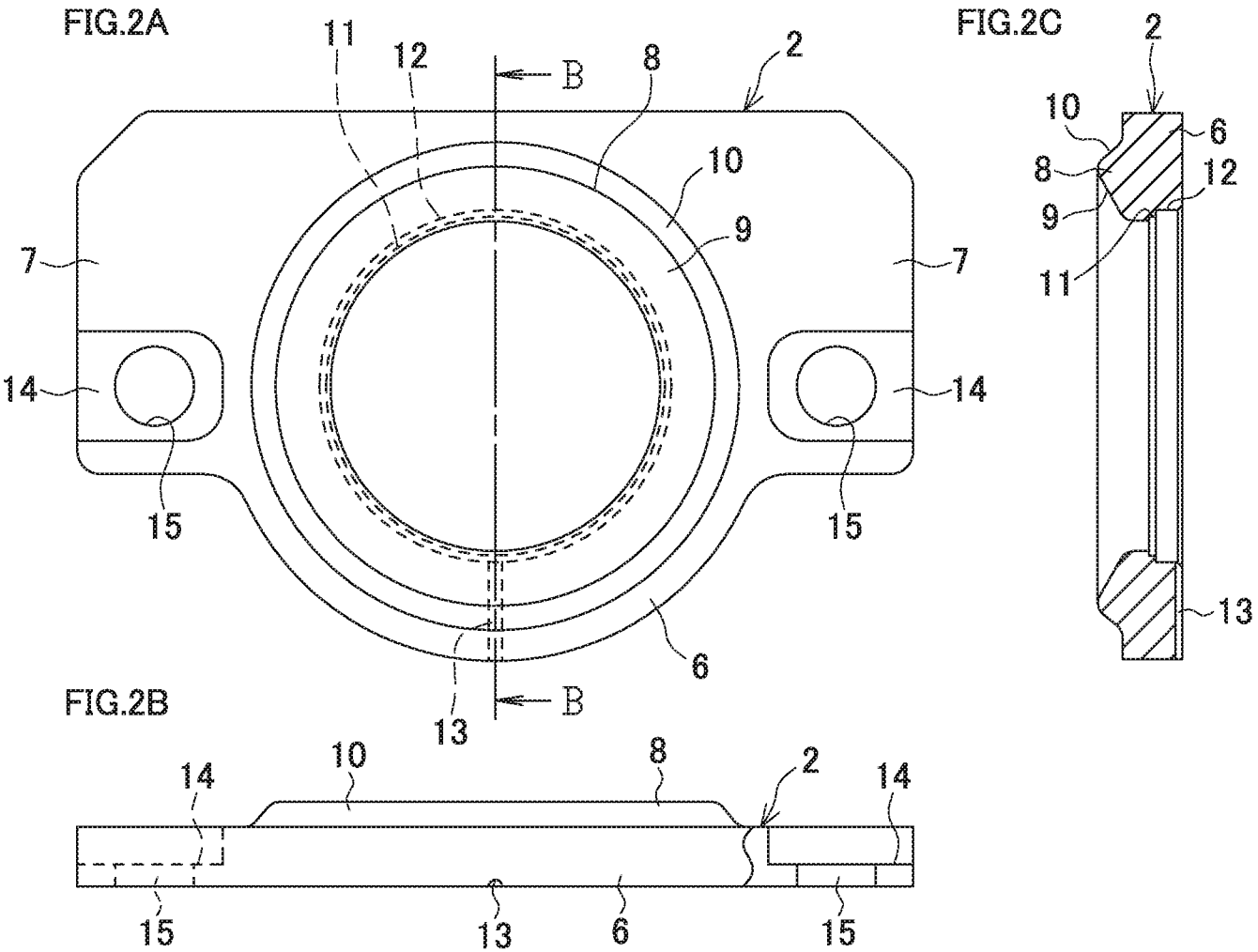
FIGS. 2A to 2C are explanatory diagrams of a lower fitting.

First, as illustrated also in FIGS. 2A to 2C, the lower fitting 2 has a plate shape having an annular supporting portion 6 at a center, and plate-shaped securing portions 7 consecutively disposed on both of right and left sides of the supporting portion 6. The supporting portion 6 has a top surface on which a projection 8 projecting upward into a mountain shape in cross-section is formed over the whole circumference. The projection 8 has a top surface having a mountain-shaped apex positioned near an outer periphery, and an inner tapered surface 9 formed inside the apex. The inner tapered surface 9 is an inclined surface that is radially wider than an outer tapered surface 10 formed outside the apex.

The supporting portion 6 has an inner peripheral surface on which a middle-diameter hole 11 and a large-diameter hole 12 are formed. The large-diameter hole 12 is positioned closer to a bottom surface side of the supporting portion 6 than the middle-diameter hole 11. The large-diameter hole 12 opens to the bottom surface side. The supporting portion 6 has a bottom surface on which a groove 13 in a radial direction is formed. The groove 13 communicates the large-diameter hole 12 with an outside on the outer peripheral side of the supporting portion 6.

Furthermore, respective depressed portions 14 are formed on the respective securing portions 7. The securing portion 7 has the depressed portions 14 that each form a mounting hole 15 penetrated through a bottom portion for securing with bolts.

Next, the upper fitting 3 has a disk shape smaller than that of the supporting portion 6 of the lower fitting 2. A lower tapered surface 16 and a circular bottom surface 17 are formed on a lower surface of the upper fitting 3. The lower tapered surface 16 is tapered off downward and opposed to the inner tapered surface 9 of the projection 8 of the supporting portion 6. The circular bottom surface 17 is positioned at a center of the lower tapered surface 16 and parallel to a bottom surface of the lower fitting 2. The upper fitting 3 has top surface on which a circular depressed portion 18 depressed downward is formed excluding an outer periphery. A disk-shaped sliding plate 19 as a sliding member made of resin is fitted to an inside of the circular depressed portion 18 to be coupled to the upper fitting 3 with a pair of screws 20 screwed from a spot facing hole of the top surface. The sliding plate 19 has a top surface projecting higher than the top surface of the upper fitting 3 in a coupling state.

Next, the rubber elastic body 4 has a coupling pipe 21 and an abutting portion 22. The coupling pipe 21 is formed into a taper shape between the projection 8 of the lower fitting 2 and the lower tapered surface 16 of the upper fitting 3. The abutting portion 22 has a circular shape in plan view. The abutting portion 22 is an abutting member integrally formed inside the coupling pipe 21 and disposed to project downward from the circular bottom surface 17 of the upper fitting 3. The rubber elastic body 4 is adhered to between the lower fitting 2 and the upper fitting 3 by vulcanization. In this state, the lower fitting 2 and the upper fitting 3 are elastically coupled to one another via the coupling pipe 21 of the rubber elastic body 4. The abutting portion 22 has a lower surface positioned on a level approximately identical to that of the apex of the projection 8 of the lower fitting 2 in an up and down direction.

Figure 3C:
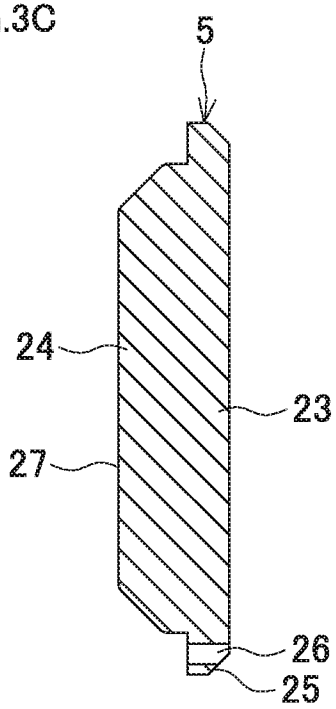
FIGS. 3A to 3C are explanatory diagrams of a press-fit fitting.
Figure 3A:
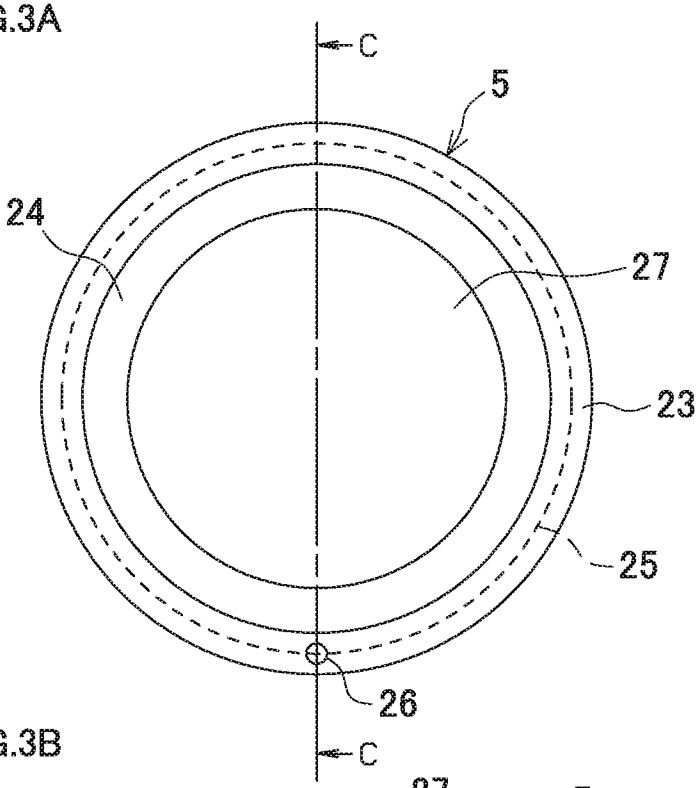
Figure 3B:
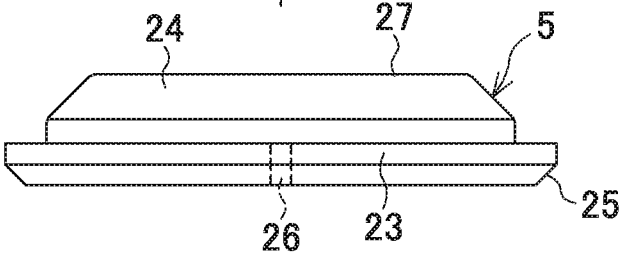

Then, as illustrated also in FIGS. 3A to 3C, the press-fit fitting 5 has a disk-shaped lower stepped portion 23 and a disk-shaped upper stepped portion 24. The lower stepped portion 23 has a diameter approximately identical to that of the large-diameter hole 12 of the supporting portion 6 of the lower fitting 2. The upper stepped portion 24 is concentrically and integrally formed on an upper side of the lower stepped portion 23 and has a diameter smaller than those of the middle-diameter hole 11 and the projection 8. The lower stepped portion 23 has a thickness identical to an axial length of the large-diameter hole 12. A taper-shaped communication groove 25 having a diameter decreasing downward is formed on an outer peripheral edge of a bottom surface of the lower stepped portion 23 over the whole circumference. A through-hole 26 is axially formed on the lower stepped portion 23 at a position overlapping the communication groove 25 in the up and down direction.

Furthermore, the upper stepped portion 24 has an upper portion formed into a taper shape having a diameter decreasing upward, and has a top surface on which a circular apical surface 27 having a diameter approximately identical to that of the circular bottom surface 17 of the upper fitting 3 is formed.

The press-fit fitting 5 is press-fitted from the bottom surface side of the supporting portion 6 such that the lower stepped portion 23 is fitted to the large-diameter hole 12. Then, the supporting portion 6 is obstructed to form an air chamber 30 surrounded by the coupling pipe 21 and the abutting portion 22 of the rubber elastic body 4 and the press-fit fitting 5 between the lower fitting 2 and the upper fitting 3. In this state, the circular apical surface 27 of the press-fit fitting 5 is positioned below the abutting portion 22 at a predetermined interval S in the up and down direction from the lower surface of the abutting portion 22.

In the state where the press-fit fitting 5 has been press-fitted, the communication groove 25 of the lower stepped portion 23 is communicated with the groove 13 of the lower fitting 2, and the through-hole 26 is open inside the middle-diameter hole 11 of the supporting portion 6 to be communicated with the air chamber 30. Accordingly, here, a communication passage 31 configured to discharge air in the air chamber 30 is formed. The air flows through the through-hole 26 from the inside of the middle-diameter hole 11. Then, the air flows from the communication groove 25 to an outside of the supporting portion 6 via the groove 13.

Figure 4:
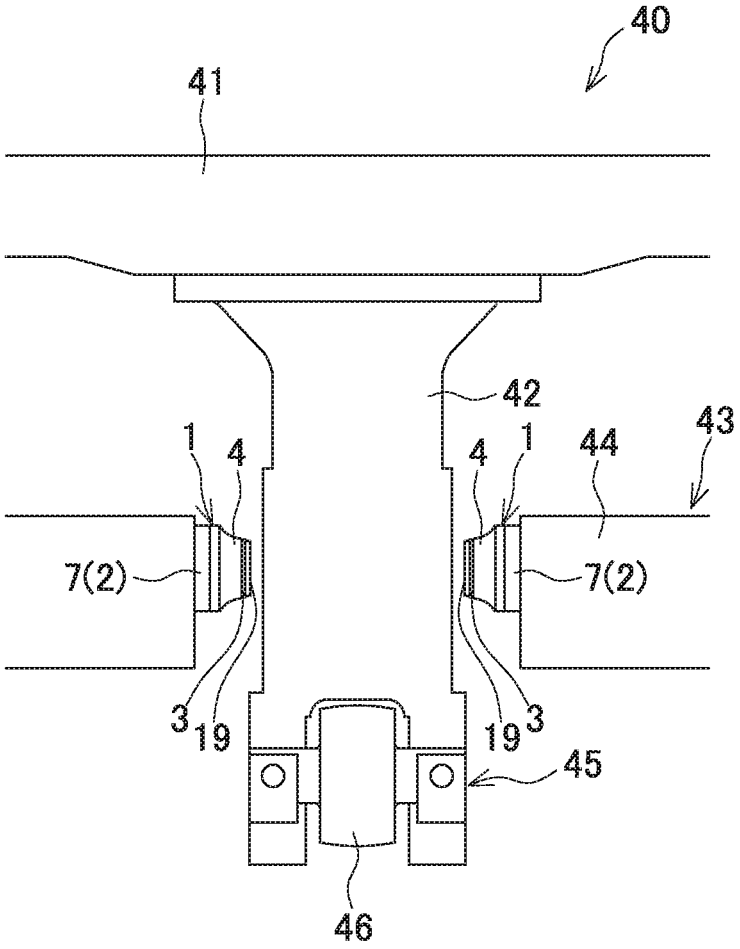
FIG. 4 is an explanatory diagram of a traction apparatus part of a railway vehicle.

The railway vehicle stopper 1 configured as described above is disposed on, for example, a railway vehicle 40 as illustrated in FIG. 4. In the railway vehicle 40, a center pin 42 is downwardly disposed on a lower portion of a vehicle body 41, and a traction apparatus 45 is configured by coupling a lower end of the center pin 42 to a truck 43 with a traction link 46. The truck 43 is disposed below the vehicle body 41. The center pin 42 passes through the truck 43. The railway vehicle stoppers 1 are opposed to the center pin 42 on right and left inner surfaces of a truck frame 44 of the truck 43, and the respective securing portions 7 of the lower fittings 2 are secured to the truck frame 44 with bolts (not illustrated). Thus, the sliding plates 19 of the upper fittings 3 are arranged opposed to side surfaces of the center pin 42 having predetermined intervals. However, a side for mounting the railway vehicle stopper 1 is not limited to the truck frame 44. The lower fittings 2 can be mounted on the center pin 42 as a side of the vehicle body 41 to dispose the sliding plates 19 opposed to the truck frame 44.

Accordingly, when the vehicle body 41 and the truck 43 relatively laterally move in curve traveling and the like, and then the sliding plate 19 of the upper fitting 3 abuts on the center pin 42, the coupling pipe 21 of the rubber elastic body 4 is axially compressed to cause elastic deformation against the load based on a spring constant of the coupling pipe 21. Further, when the relatively lateral motion of the vehicle body 41 and the truck 43 proceeds, and then the abutting portion 22 of the rubber elastic body 4 abuts on the circular apical surface 27 of the press-fit fitting 5, the abutting portion 22 is axially compressed to cause elastic deformation against the load based on a spring constant of the abutting portion 22. Such a two-stage spring characteristic will reduce rolling.

Even if such elastic deformation of the coupling pipe 21 and the abutting portion 22 compresses the air chamber 30, the inside air is discharged outside the lower fitting 2 through the communication passage 31, thus not affecting the elastic deformation of the coupling pipe 21 and the abutting portion 22.

Then, when the two-stage spring characteristic is adjusted, any spring characteristic can be obtained by changing, for example, a height (the interval S with the abutting portion 22), a shape, and a material of the circular apical surface 27 of the press-fit fitting 5. In this case, it is enough to replace or remodel (for example, cut) only the press-fit fitting 5 without changing the lower fitting 2, the upper fitting 3, and the rubber elastic body 4. Therefore, the need for remodeling of the mold is eliminated. Even if the press-fit fitting 5 is newly replaced, insofar as the prior press-fit fitting 5 is left, it is easy to return to the spring characteristic before the change.

Figure 5C:
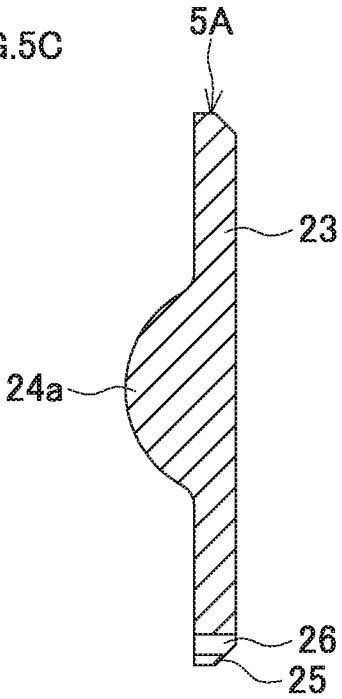
FIGS. 5A to 5C are explanatory diagrams of a modification example of the press-fit fitting.
Figure 5A:
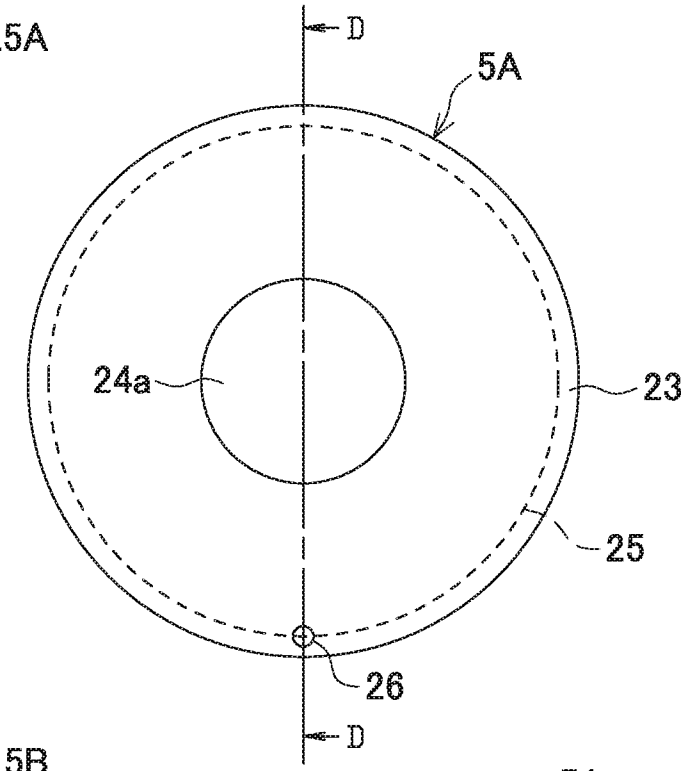
Figure 5B:
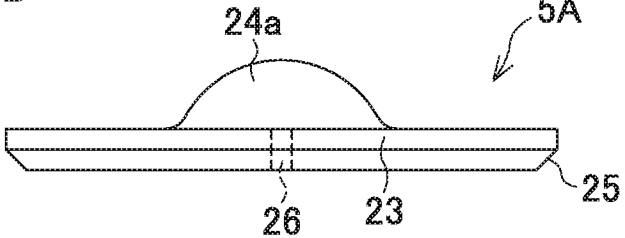

FIGS. 5A to 5C illustrate a modification example of the press-fit fitting. In the press-fit fitting 5A, an upper stepped portion 24*a* is bulged upward into a hemispherical shape from a center on a top surface of the lower stepped portion 23. The spring characteristic is adjusted by the elastic deformation which is caused by the abutting portion 22 abutting on a top surface of the upper stepped portion 24*a*.

Figure 6C:
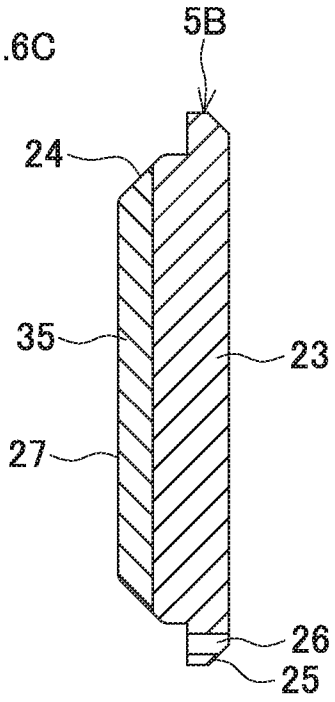
FIGS. 6A to 6C are explanatory diagrams of a modification example of the press-fit fitting.
Figure 6A:
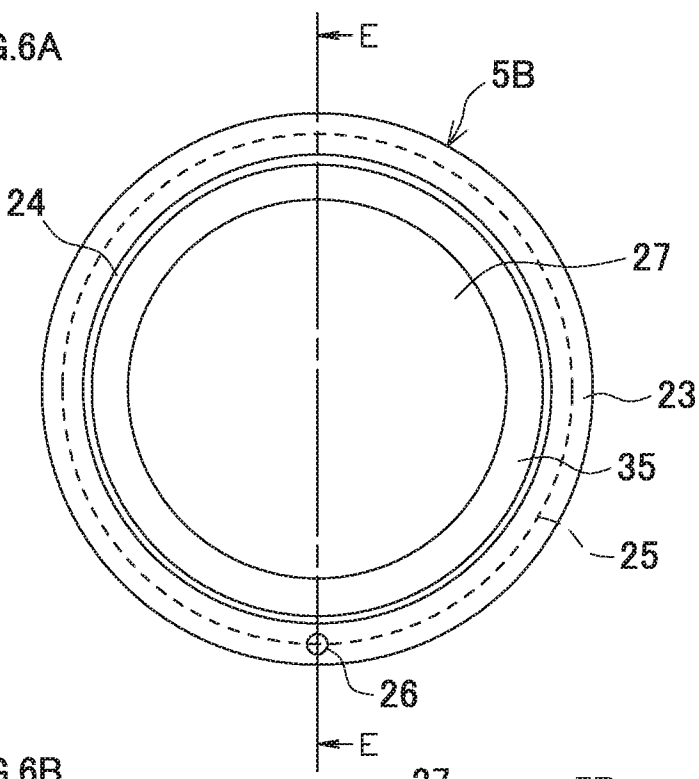
Figure 6B:
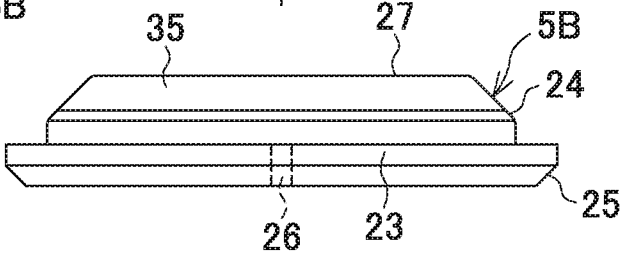

In a press-fit fitting 5B in a modification example illustrated in FIGS. 6A to 6C, the upper stepped portion 24 has a shape identical to that of the prior form, however an upper side part including a surface opposed to the abutting portion 22 is formed from resin as a body separately from the fitting. The upper side part is fixedly secured to the fitting as a plate 35 as a fourth rigid member, thus adjusting the spring characteristic.

As described above, the railway vehicle stopper 1 is configured to include the lower fitting 2 having the annular supporting portion 6 and the securing portions 7 positioned on the outer peripheral side of the supporting portion 6 to be secured to the truck frame 44, the upper fitting 3 arranged opposed to the vehicle body 41 having the interval, the rubber elastic body 4 that elastically couples the supporting portion 6 of the lower fitting 2 to the upper fitting 3, the press-fit fitting 5 mounted inside the supporting portion 6 of the lower fitting 2 to form the air chamber 30 with the upper fitting 3, the abutting portion 22 coupled to the upper fitting 3, and the communication passage 31 disposed on the press-fit fitting 5 to communicate the air chamber 30 with the outside. Therefore, the need for remodeling the mold is eliminated, thus allowing the adjustment of the two-stage spring characteristic with the replacement or the remodeling of only the press-fit fitting 5, 5A, or 5B. Accordingly, the adjustment of the two-stage spring characteristic can be performed at low cost. It is also possible to easily return to the two-stage spring characteristic before the adjustment with the replacement of the press-fit fitting 5, 5A, or 5B, thus improving freedom of design.

Especially, here, the communication passage 31 is configured to have the through-hole 26 formed on the press-fit fitting 5 to pass through the press-fit fitting 5 in a thickness direction and the communication groove 25 formed on the bottom surface as a surface abutting on the truck frame 44 of the press-fit fitting 5 to be continuous with the through-hole 26. Therefore, the communication passage 31 is easily formed using the press-fit fitting 5.

The communication groove 25 is formed on the outer peripheral edge of the bottom surface of the press-fit fitting 5. Therefore, the communication groove 25 is easily formed using the outer peripheral edge of the press-fit fitting 5. Especially, since the communication groove 25 is disposed on the entire outer peripheral edge, the communication groove 25 can be easily continuous with the through-hole 26.

Furthermore, the sliding plate 19 is disposed on the side of the vehicle body 41 or the truck frame 44 of the upper fitting 3, which allows the railway vehicle stopper 1 to smoothly abut on the vehicle body 41 or the truck frame 44.

Then, employing the press-fit fitting 5 press-fitted inside the supporting portion 6 facilitates the mounting of the press-fit fitting 5.

Especially, the plate 35 made of resin including the surface opposed to the upper fitting 3 is mounted on the press-fit fitting 5B, thus ensuring finer adjustment of the spring characteristic with the press-fit fitting 5B.

Figure 7C:
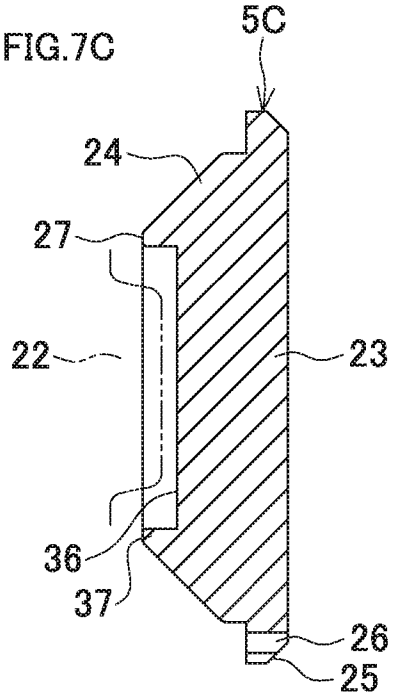
FIGS. 7A to 7C are explanatory diagrams of a modification example of the press-fit fitting.
Figure 7A:
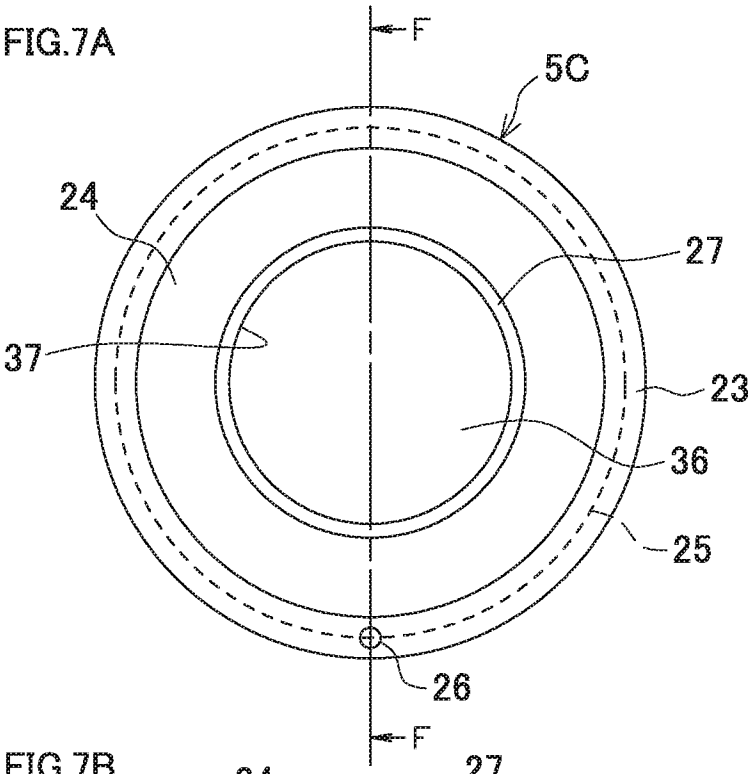
Figure 7B:
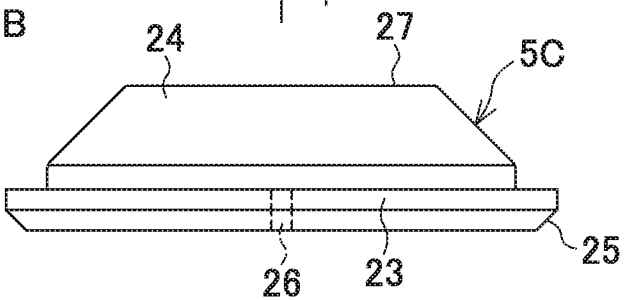

On the other hand, as the press-fit fitting, for example, as a press-fit fitting 5C illustrated in FIGS. 7A to 7C, it is also possible to form the upper stepped portion 24 such that the circular apical surface 27 is higher than the lower surface of the abutting portion 22 on a side of the upper fitting 3 and form a depressed portion 36 having a circular shape in plan view into which the lower end of the abutting portion 22 is movably inserted on the circular apical surface 27. Thus, a ring-shaped stopper 37 that contactlessly covers a side surface (a peripheral surface) of the abutting portion 22 around the abutting portion 22 is formed.

As described above, when the stopper 37 arranged having a predetermined interval with the side surface of the abutting portion 22 is disposed on the press-fit fitting 5C, the abutting portion 22 that has relatively moved in a sliding direction interferes with the stopper 37 to cause the elastic deformation. Therefore, the adjustment of the spring characteristic in the sliding direction is ensured.

However, the stopper is not necessary to be disposed over the whole circumference of the abutting portion, and it is allowed to partially upright dispose a pair of stoppers positioned back and forth across the abutting portion in the sliding direction.

In the above-described forms, the abutting portion as the abutting member is disposed on the upper fitting, however the abutting portion may be disposed on the lower fitting, or the respective abutting portions may be disposed on both of the upper fitting and the lower fitting. Obviously, an abutting portion as a separate body can be used to be mounted on one or both fittings.

Furthermore, also for the form of the communication passage, the communication passage is formed on the entire outer peripheral edge of the bottom surface of the press-fit fitting in the above-described form, however the communication passage may be partially provided, or the groove on a side of the lower fitting may be omitted insofar as only the through-hole and the communication passage of the press-fit fitting can communicate the air chamber with the outside.

Figure 8:
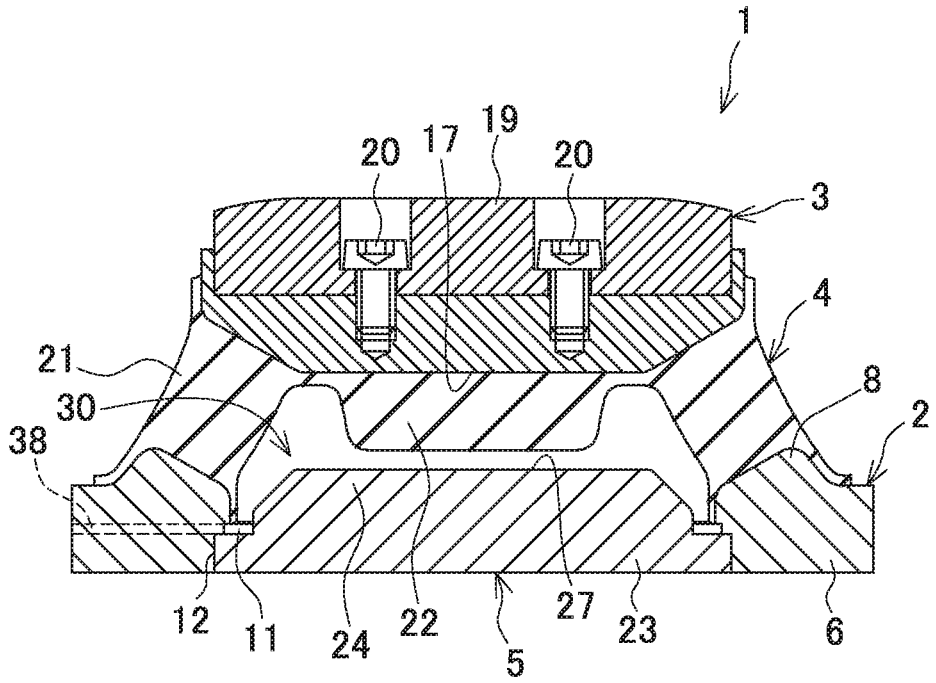
FIG. 8 is a center vertical cross-sectional view of a railway vehicle stopper illustrating a modification example of a communication passage.

Then, the communication passage is not limited to the case provided on the press-fit fitting. For example, as illustrated in FIG. 8, a through-hole 38 in a radial direction communicated with the middle-diameter hole 11 can be formed through the supporting portion 6 of the lower fitting 2. A communication passage across the press-fit fitting and the supporting portion can be formed by, for example, providing respective depressed grooves on the outer periphery of the press-fit fitting and the inner periphery of the supporting portion.

Additionally, the third rigid member is not limited to the press-fit fitting. A fitting having a male threaded portion on an outer periphery to be screwed with a female threaded portion formed inside the supporting portion and a fitting secured to the lower fitting with a screw or a bolt may be used. For example, the shape of the lower fitting and the shape in plan view of the upper fitting are also not limited to above-described forms, and can be changed as necessary such that the upper fitting is shaped into a square shape or a rectangular shape other than the circular shape.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A railway vehicle stopper interposed between a vehicle body and a truck frame of a railway vehicle, the railway vehicle stopper comprising:

a first rigid member having an annular supporting portion and a securing portion positioned at an outer peripheral side of the supporting portion, the securing portion being secured to the vehicle body or the truck frame;

a second rigid member arranged opposed to the truck frame or the vehicle body with an interval, wherein the first rigid member and the second rigid member are superposed in an axial direction of the railway vehicle stopper;

a rubber elastic body that extends between the first rigid member and the second rigid member in the axial direction of the railway vehicle stopper, wherein a first axial end of the rubber elastic body is connected to the supporting portion of the first rigid member and a second axial end of rubber elastic body is connected to the second rigid member so as to elastically couple the first rigid member to the second rigid member;

a third rigid member mounted inside the supporting portion of the first rigid member to form an air chamber with the second rigid member;

an abutting member coupled to at least one of mutually opposed surfaces of the second rigid member and the third rigid member;

a communication passage provided on one or both of the first rigid member and the third rigid member to communicate the air chamber with an outside, and wherein the first axial end and the second axial end are both ends of the rubber elastic body in the axial direction of the railway vehicle stopper.

2. The railway vehicle stopper according to claim 1, wherein a fourth rigid member having a surface opposed to the second rigid member is mounted on the third rigid member.

3. The railway vehicle stopper according to claim 1, wherein the abutting member is disposed on the second rigid member, and at least a pair of stoppers are arranged on the third rigid member having a predetermined interval with a side surface of the abutting member.

4. The railway vehicle stopper according to claim 1, wherein a sliding member is disposed on a side of the truck frame or the vehicle body in the second rigid member.

5. The railway vehicle stopper according to claim 1, wherein the third rigid member is press-fitted inside the supporting portion.

6. A railway vehicle stopper interposed between a vehicle body and a truck frame of a railway vehicle, the railway vehicle stopper comprising:

a first rigid member having an annular supporting portion and a securing portion positioned at an outer peripheral side of the supporting portion, the securing portion being secured to the vehicle body or the truck frame;

a second rigid member arranged opposed to the truck frame or the vehicle body with an interval;

a rubber elastic body that elastically couples the supporting portion of the first rigid member to the second rigid member;

a third rigid member mounted inside the supporting portion of the first rigid member to form an air chamber with the second rigid member;

an abutting member coupled to at least one of mutually opposed surfaces of the second rigid member and the third rigid member; and a communication passage provided on one or both of the first rigid member and the third rigid member to communicate the air chamber with an outside, wherein the communication passage has a through-hole and a communication groove, the through-hole being formed on the third rigid member through the third rigid member in a thickness direction, the communication groove being formed on a surface abutting on the vehicle body or the truck frame in the third rigid member to be continuous with the through-hole.

7. The railway vehicle stopper according to claim 6, wherein the communication groove is formed on an outer peripheral edge of the abutting surface.

8. The railway vehicle stopper according to claim 6, wherein the communication groove is formed on an entire outer peripheral edge of the abutting surface.

* * * * *